United States Patent [19]

Ross

[11] 3,959,998

[45] June 1, 1976

[54] PIPE SWAGING APPARATUS

[76] Inventor: Bernard D. Ross, 2710 Emmick Drive, Toledo, Ohio 43606

[22] Filed: Aug. 16, 1974

[21] Appl. No.: 498,033

Related U.S. Application Data

[63] Continuation-in-part of Ser. No. 284,734, Aug. 30, 1972, Pat. No. 3,838,591.

[52] U.S. Cl. ..... 72/312; 72/317; 269/25

[51] Int. Cl.[2] ..... B21D 41/02

[58] Field of Search ..... 72/312, 313, 316, 317, 72/318, 393, 295, 296, 297, 298, 417; 269/25, 32, 34, 20, 27, 30

[56] References Cited

UNITED STATES PATENTS

| | | | |
|---|---|---|---|
| 976,285 | 11/1910 | Osmer | 269/30 |
| 2,328,061 | 8/1943 | Curtis | 269/30 |
| 3,187,547 | 6/1965 | Ribback | 72/402 |
| 3,411,338 | 11/1968 | Carlin | 72/316 |
| 3,452,975 | 7/1969 | Morrison | 269/20 |
| 3,610,016 | 10/1971 | Bultman | 72/317 |

*Primary Examiner*—Lowell A. Larson
*Assistant Examiner*—Gene P. Crosby
*Attorney, Agent, or Firm*—Robert H. Epstein

[57] ABSTRACT

Pipe swaging apparatus includes a swaging fluid motor for moving a swage die toward a pipe clamping assembly including a stationary bottom clamping plate and a movable top clamping plate and a clamp operating fluid motor mounted beneath the bottom clamping plate and having a piston rod coupled with the top clamping plate to permit automatic operation of the pipe clamping assembly preferably simultaneously with operation of the swaging fluid motor.

1 Claim, 4 Drawing Figures

PIPE SWAGING APPARATUS

This application is a continuation-in-part of patent application Ser. No. 284,734 filed Aug. 30, 1972, now U.S. Pat. No. 3,838,591.

BACKGROUND OF THE INVENTION

1. Field of the Invention

The present invention pertains to swaging and, more particularly, to apparatus for automatically swaging pipe.

2. Discussion of the Prior Art

In many industries, particularly the automotive industry, it is required that pipes have specially configured or swaged ends either to provide a desired appearance or to facilitate the joining or coupling of pipes. Vehicles, particularly automobiles, require pipes having swaged ends for exhaust systems, and the fabrication of such pipes presents a problem in the exhaust system and muffler replacement industry due to the vast inventory required to service the various makes and models of automobiles. In order to overcome this problem, many establishments have pipe bending and swaging machinery on the premises such that a supply of straight pipes may be stocked and each pipe can be bent to the configuration required for the automobile to be serviced at that time.

Many attempts have been made to automate pipe bending machines in order to decrease the element of human error in the bending of pipes and the time required to bend a pipe. In U.S. Pat. No. 3,766,764, an automatic pipe bender is disclosed which permits the bending of pipe inexpensively and with great speed, and the use of this automatic pipe bender has been found to be so effective as to permit a central pipe bending shop utilizing the automatic pipe bender to supply specially bent pipes to a large number of establishments servicing automobiles by replacing exhaust systems and mufflers. The use of this automatic pipe bender, however, permits the production of bent pipes at much faster rates than the rate at which existing swagers can be utilized to swage the ends of the pipes.

One of the primary reasons for the slowness of existing swagers is that prior to a swaging operation, an operator must manually loosen collet clamping plates, insert a pipe to be swaged, position a set of collets around the pipe and within the clamping plates and then tighten the clamping plates to hold the pipe stationary during swaging. The steps required of the operator are time consuming due to the manual operation required in tightening the clamping plates prior to the swaging operation and the loosening of the clamping plates after the swaging operation to remove the pipe.

SUMMARY OF THE INVENTION

Accordingly, it is an object of the present invention to overcome the disadvantages of the prior art by increasing the speed of operation of swaging apparatus.

The present invention is generally summarized in pipe swaging apparatus including a swager support having a pipe clamping area, a swaging fluid motor supported on the swager support and having a piston rod for moving a swage die toward the pipe clamping area, pipe clamping means supported on the swager support at the pipe clamping area including a stationary bottom clamping plate and a movable top clamping plate, and a clamp operating fluid motor mounted on the swager support at the pipe clamping area beneath the bottom clamping plate and having a piston rod coupled with the top clamping plate for moving the top clamping plate relative to the bottom clamping plate whereby a pipe to be swaged can be held stationary during swaging by operation of the clamp operating fluid motor.

Another object of the present invention is to automatically operate a pipe clamping assembly for swaging apparatus.

A further object of the present invention is to clamp a set of collets around a pipe to be swaged by moving a top collet clamping plate toward a stationary bottom collet clamping plate with a fluid motor disposed beneath te bottom collet clamping plate.

The present invention has another object in the actuation of a pipe clamp operating fluid motor simultaneously with a swaging fluid motor such that pipe clamping and swaging are effectively accomplished simultaneously in a single step.

Some of the advantages of the present invention over the prior art are that the swaging apparatus of the present invention substantially decreases the time and manual labor required to swage a pipe and, accordingly, decreases costs and that the pipe clamp operating fluid motor is disposed under the swaging apparatus so as to minimize danger to personnel and not to interfere with operation of the swaging apparatus.

Other objects and advantages of the present invention will become apparent from the following description of the preferred embodiment taken in conjunction with the accompanying drawings.

DESCRIPTION OF THE PREFERRED EMBODIMENT

Figure 2:
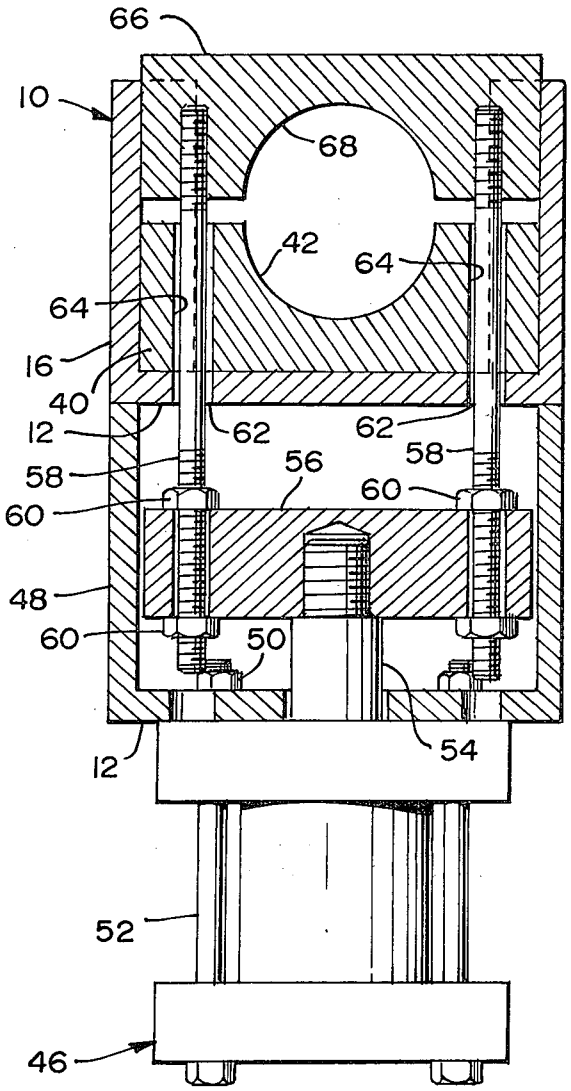
FIG. 2 is a section taken along line 2—2 of FIG. 1.
Figure 1:
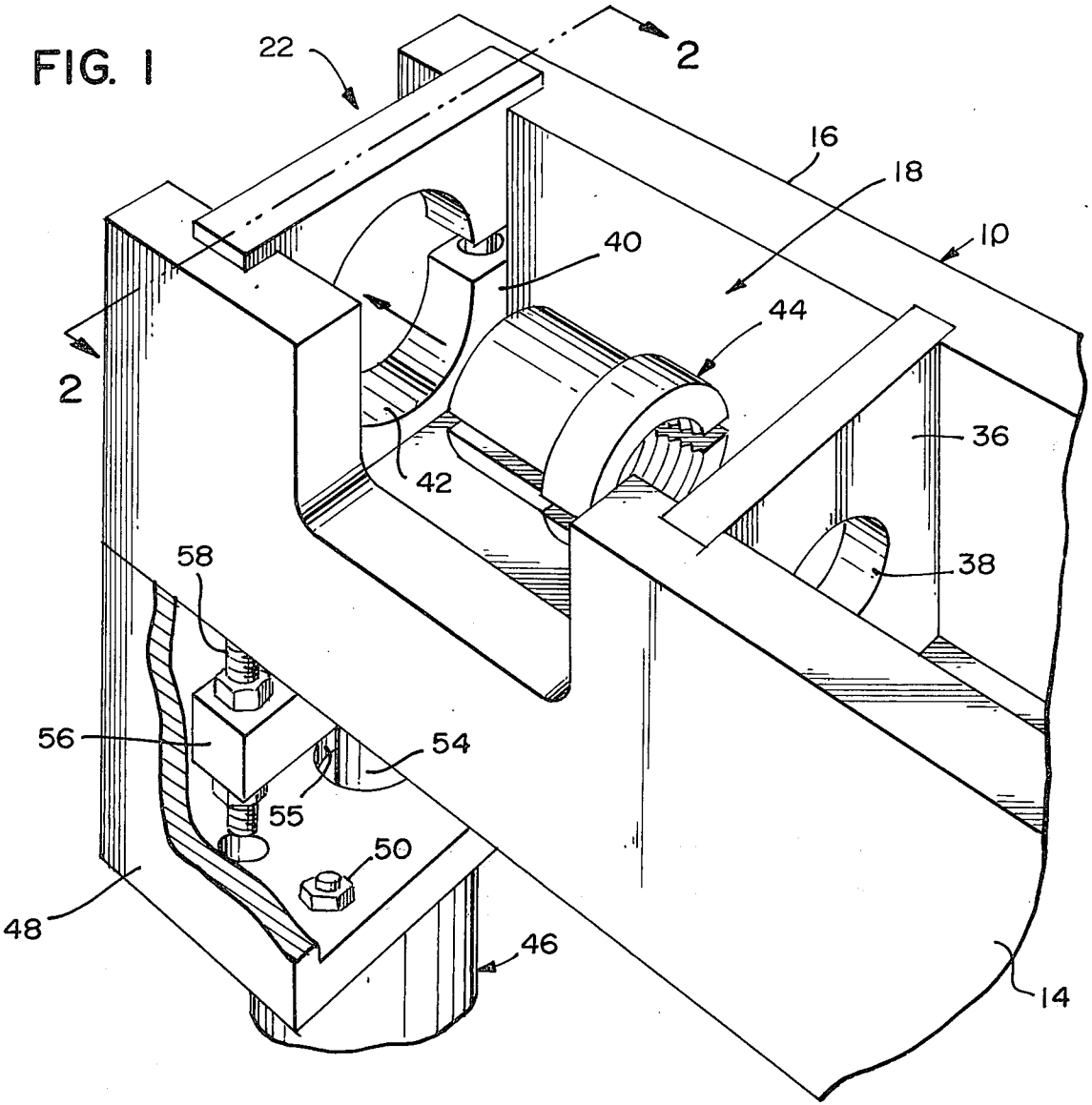
FIG. 1 is a broken perspective of pipe swaging apparatus according to the present invention.

Apparatus according to the present invention for swaging the end of a pipe is illustrated in FIGS. 1 through 4 and includes a swager support 10 having a U-configuration in cross section with a base 12 and opposing side walls 14 and 16. A swaging area 18 is defined in swager support 10 with a swage die driving area 20 disposed on one side of the swaging area and a pipe clamping area 22 disposed on the other side of the swaging area.

A swaging fluid motor 24 is supported at the swage die driving area 20 of the swager support 10 and includes a cylinder 26 having a piston movable therein and a piston rod 28 axially movable toward and away from the swaging area 18. Piston rod 28 has an end 30, preferably threaded, to receive a swage die 32, and the piston rod is slidably movable through an aperture in a wall 34. A peeling plate 36 is disposed in channels in side walls 14 and 16 longitudinally spaced from wall 34 and has an aperture 38 therein of a size to accomodate the swage die being used.

At the pipe clamping area 22, side walls 14 and 16 each have a channel formed therein to receive a bottom collet clamping plate 40 having a top edge with a central arcuate recess 42 therein. A pair of collets 44 have an external configuration to be received in arcuate recess 42 and have a ribbed internal surface to grip a pipe to be swaged. The bottom clamping plate 40 remains stationary during swaging operations.

A clamp operating fluid motor 46 is mounted on the underside of base 12 of swager support 10 at the pipe clamping area beneath the bottom clamping plate 42. The clamp operating fluid motor 46 is mounted on the bottom of a U-shaped member 48 by four bolts 50, and the member 48 is secured to the underside of base 12 by welding. The clamp operating fluid motor 46 includes a cylinder 52 controlling a piston rod 54 which extends through a hole 55 in the bottom of bracket 48 to threadedly engage a block 56. A pair of parallel, vertically threaded rods 58 are mounted on block 56 by nuts 60 and extend through holes 62 in base 12 of swager support 10 and vertical bores 64 in bottom clamping plate 40 on opposite sides of recess 42 to threadedly engage a top clamping plate 66 on opposite sides of a central arcuate recess 68 in the bottom edge thereof.

Figure 3:
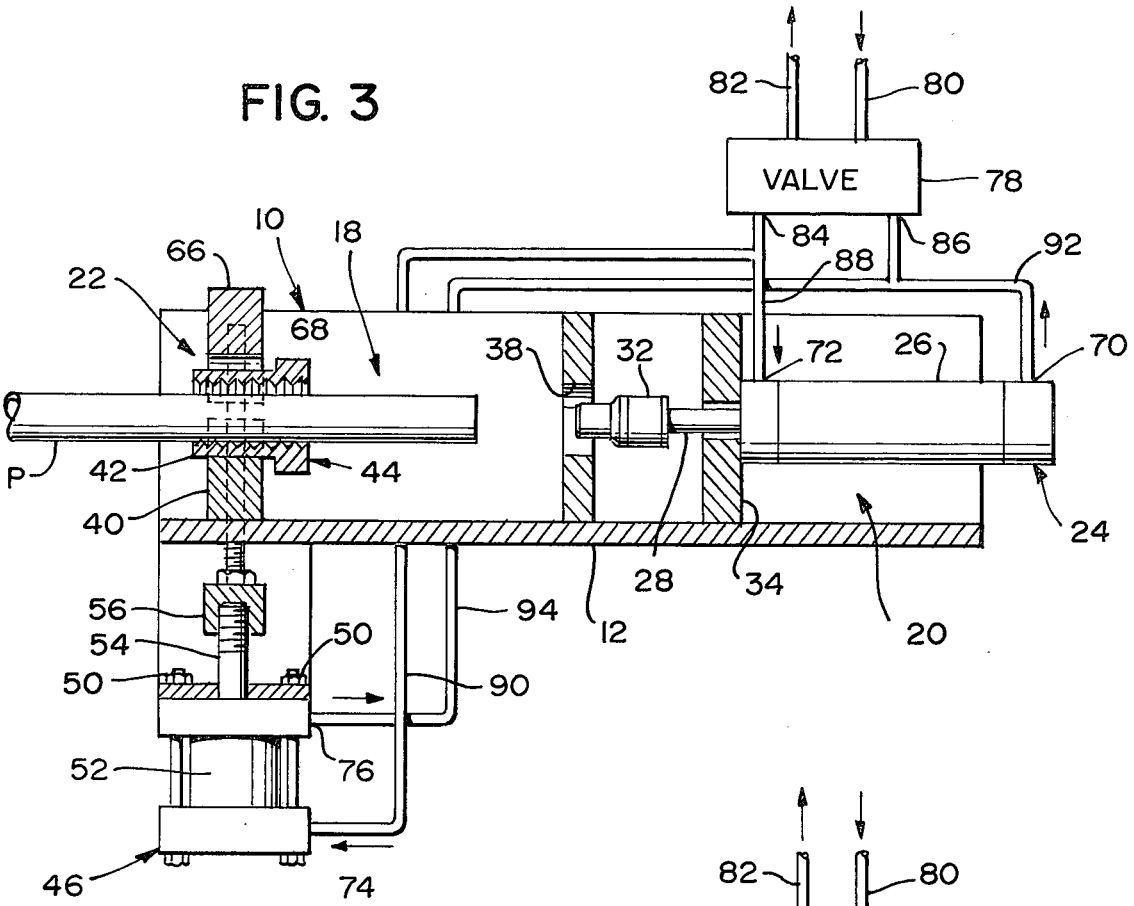
FIGS. 3 and 4 are diagrammatical views, partly in section, of the pipe swaging apparatus of FIG. 1 in rest and operative conditions, respectively.
Figure 4:
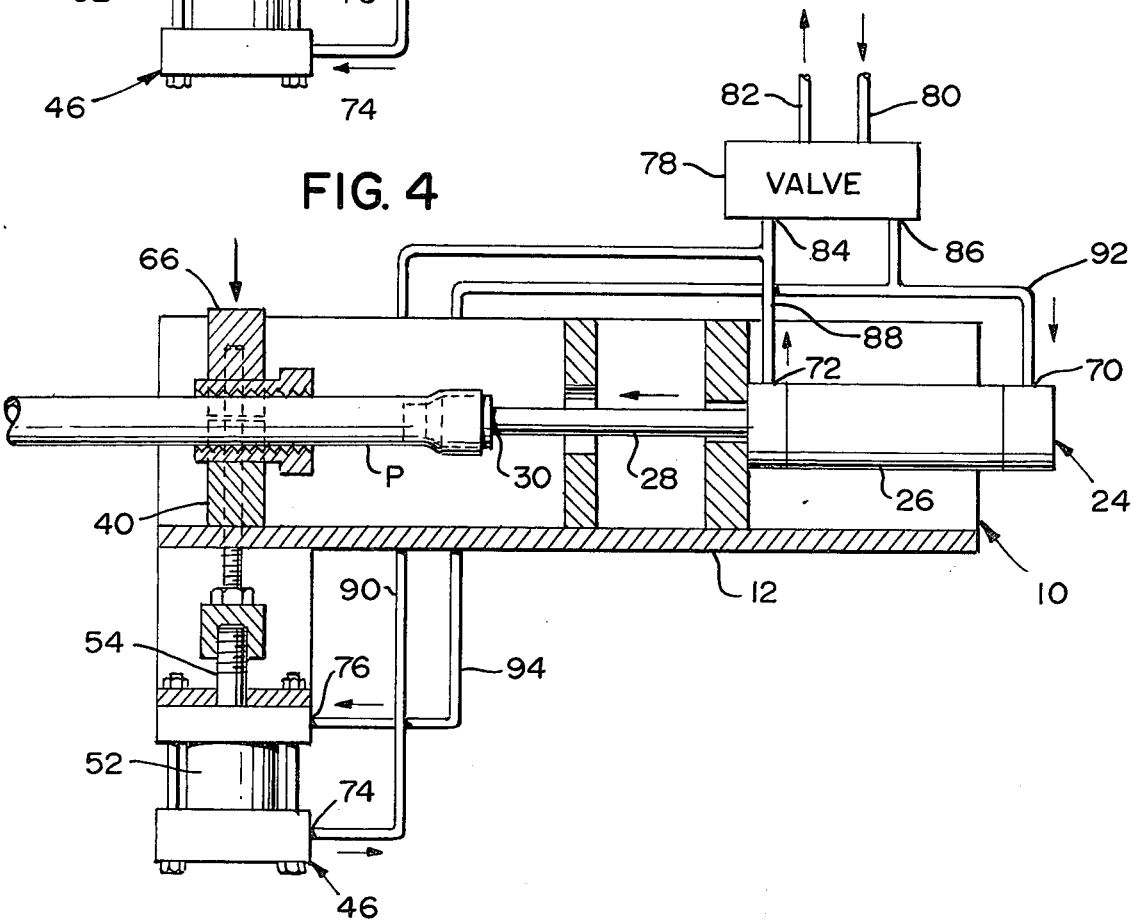

As shown in FIGS. 3 and 4, the swaging cylinder 26 of swaging fluid motor 24 has an advance port 70 at one end thereof and a retract port 72 at its opposite end; and, similarly, the clamp operating cylinder 52 of clamp operating fluid motor 46 has advance and retract ports 74 and 76, respectively, at opposite ends thereof. A control system for the swaging and clamp operating fluid motors includes valve means 78 receiving fluid at an inlet 80 from any suitable source (not shown) and exhausting fluid through an outlet 82 to the atmosphere when air is used or to a reservoir when a closed system, such as a hydraulic system, is utilized. Valve means 78 is operative in a first state to supply fluid pressure from the source through inlet 80 to a port 84 and to connect outlet 82 with a port 86 such that fluid pressure is supplied through conduits 88 and 90 to retract port 72 and advance port 74, respectively, of the swaging and clamp operating cylinders while movement of pistons within the swaging and clamp operating cylinders is permitted by fluid flow through conduits 92 and 94 from the advance port 70 and the retract port 76, respectively, of the swaging and clamp operating cylinders to port 86 and through the valve means 78 to outlet 82. In a second state, valve means 78 supplies fluid pressure at port 86 through conduits 92 and 94 to advance port 70 and retract port 76, respectively, of the swaging and clamp operating cylinders and connects port 84 with outlet 82 to permit exhausting of the fluid within the cylinders through conduits 88 and 90.

In operation, valve means 78 is normally in its first state such that the swaging apparatus is in the rest condition illustrated in FIG. 3 with swaging piston rod 28 retracted and clamp operating piston rod 54 advanced to move the top clamping plate 66 away from the bottom clamping plate 40. With the swaging apparatus in the rest condition, a suitable swage die 32 is threaded on the end 30 of swaging piston rod 28, and a pipe P to be swaged is positioned in swager support 10 with the end to be swaged at the swaging area 18. The set of collets 44 are disposed around the pipe P and are received in the arcuate recess 42 in the bottom clamping plate 40.

In order to swage the pipe P, the swaging apparatus is placed in the operative condition by actuating valve means 78 to place it in its second state thereby simultaneously operating swaging fluid motor 24 and clamp operating fluid motor 46 to move swaging piston rod 28 toward the end of the pipe P to be swaged and to move clamp operating piston rod 54 down such that the top clamping plate 66 is moved toward the bottom clamping plate 40. The top and bottom clamping plates are aligned such that the arcuate recess 68 of the top clamping plate 66 receives the set of collets 44 to clamp the collets together and grip the pipe P. In this manner, the pipe P is held stationary during the swaging operation accomplished by movement of the swage die 32 into the end of pipe P; and, once the swaging operation is completed, the valve means 78 is returned to its first state to retract swaging piston rod 28 and advance clamp operating piston rod 54 to their rest positions. With the simultaneous retracting movement of the swage die 32 and the movement of top clamping plate 66 away from the bottom clamping plate 40, the pipe P will be free to move along with the swage die 32 to be peeled from the swage die by peeling plate 36.

With the clamp operating fluid motor 46 disposed under the swager support 10, the clamp operating fluid motor does not interfere with the positioning of a pipe to be swaged and does not represent a hazard for personnel operating the apparatus. While it is preferred to position the clamp operating fluid motor directly beneath the bottom clamping plate with the rods passing therethrough to couple the top clamping plate with the clamp operating piston rod, the clamp operating fluid motor can be disposed at any position on the underside of the swager support adajcent the bottom clamping plate with the clamp operating piston rod coupled with the top clamping plate in any suitable manner. To this end, the clamp operating fluid motor can be secured to the swager support in any suitable manner so as to be permanent or removable.

Any desirable swage die 32 having a configuration to provide a desired swaged end on a pipe can be secured to the end 30 of swaging piston rod 28. When different configurations of swage dies are utilized, the peeling plate 36 can be changed to provide an appropriate size aperture 38 to permit advance and retracting movement of the swage die. The control system for the swaging and pipe clamping fluid motors is desirably a hydraulic system such that the clamp operating apparatus can be integrally connected with the control systems of conventional pipe benders and swagers.

Inasmuch as the present invention is subject to many variations, modifications and changes in detail, it is intended that all matter described above or shown in the accompanying drawings be interpreted as illustrative and not in a limiting sense.

I claim:

1. Pipe swaging apparatus comprising swager support means having a pipe clamping area;

swaging fluid motor means supported on said swager support means and having a piston rod for moving a swage die toward said pipe clamping area;

pipe clamping means supported on said swager support means at said pipe clamping area including a stationary bottom clamping plate and a movable top clamping plate;

a U-shaped member secured to said swager support means at said pipe clamping area beneath said bottom clamping plate;

clamp operating fluid motor means mounted on said U-shaped member and having a piston rod extending from said fluid motor through said U-shaped member, a block positioned and movable within said U-shaped member and carried by said piston rod and a pair of parallel rods mounted on said block and extending through said bottom clamping plate to couple said piston rod with said top clamping plate for moving said top clamping plate relative to said bottom clamping plate whereby a pipe to be swaged can be held stationary during swaging by said clamp operating fluid motor means, said swaging fluid motor means including a cylinder having an advance port and a retract port and said clamp operating fluid motor means including a cylinder having an advance port and a retract port; and valve means having a first state for supplying fluid to said retract port of said swaging cylinder and said advance port of said clamp operating cylinder to retract said swaging piston rod and advance said clamp operating piston rod to move said top clamping plate away from said bottom clamping plate and a second state for supplying fluid to said advance port of said swaging cylinder and said retract port of said clamp operating cylinder to advance said swaging piston rod and retract said clamp operating piston rod to move said top clamping plate toward said bottom clamping plate whereby swaging and clamping of a pipe are provided simultaneously.

* * * * *